US006508931B1

(12) United States Patent
Lin et al.

(10) Patent No.: US 6,508,931 B1
(45) Date of Patent: Jan. 21, 2003

(54) PROCESS FOR THE PRODUCTION OF WHITE OIL

(75) Inventors: Wen-Fa Lin, Hsinchu (TW); Jen-Min Chen, Hsinchu (TW); Jun-Yi Chen, Hsinchu (TW); Kuang-Hua Tsai, Hsinchu (TW)

(73) Assignee: Chinese Petroleum Corporation, Taipei (TW)

( * ) Notice: Subject to any disclaimer, the term of this patent is extended or adjusted under 35 U.S.C. 154(b) by 0 days.

(21) Appl. No.: 09/703,380

(22) Filed: Oct. 31, 2000

(51) Int. Cl.[7] ..... C10G 45/00; C10G 45/02; C07C 5/22

(52) U.S. Cl. ..... 208/142; 208/143; 208/144; 208/145; 208/268; 585/250

(58) Field of Search ..... 208/142, 143, 208/144, 145, 268; 585/250

(56) References Cited

FOREIGN PATENT DOCUMENTS

EP 096289 A2 * 5/1983

OTHER PUBLICATIONS

The English abstract of EP 096289A2.*

* cited by examiner

*Primary Examiner*—Thuan D. Dang
(74) *Attorney, Agent, or Firm*—Thorp Reed & Armstrong

(57) ABSTRACT

A process for the production of white oil includes adding a supercritical fluid (propane, butane or carbon dioxide) to the base oil and hydrogen injected into a reactor for hydrogenation. The base oil and supercritical fluid use high-pressure injector pumps as the feed system. The feed system for hydrogen uses a high-pressure compressor to compress hydrogen from a hydrogen tank to a storage tank, then a mass flow controller is used to steadily feed the hydrogen. A static mixer mounted in line, upstream from the inlet of the reactor mixes the reactant well. Several thermocouples are connected to the reactor, inlet and outlet of said reactor to measure the temperatures of the reaction. The detected data from the thermocouples are transferred to a six-point thermograph. The pressure of the reaction is maintained by a back pressure regulator that is mounted downstream from the outlet of said reactor. After the hydrogenation reaction is complete, the pressure of the fluid in the outlet of the reactor is reduced. A vapor-liquid separator is used to separate the vapor and liquid. The total flow of the vapor is recorded using a gas meter.

5 Claims, 2 Drawing Sheets

PROCESS FOR THE PRODUCTION OF WHITE OIL

BACKGROUND OF THE INVENTION

1. Field of the Invention

The present invention relates to a process for refining base oil, more particularly, to a hydrogenation reaction to obtain white oil from base oil.

2. Description of Related Art

The composition of base oil from petroleum refining process is very complex, and there are many saturated and unsaturated hydrocarbons with nitrogen and sulfur compounds making the base oil look yellow. Consequently, a decolorizing process is usually used to obtain white oil. The conventional decolorizing process includes an oleum/clay method and a hydrogenation method. The quality of white oil obtained by the oleum/clay method is not so good, and the acid in the reaction is not easy to process and can easily pollute the environment. So many companies do not use this method to produce white oil gradually.

The other method, the hydrogenation method, does not have the same drawbacks as the oleum/clay method. In the hydrogenation method, base oil is fed in liquid state into a reactor and hydrogen is continuously pumped into the reactor. Base oil is fed into the reactor through an inlet above the reactor. The reaction is controlled by the mass transfer resistance of the vapor/liquid phase and liquid/solid phase so the reaction must be carried out at high temperature (about 250~380° C.) and high pressure (~3000 psi). The mass transfer resistance also makes the reaction more difficult, and the cost of equipment to obtain white oil is higher.

SUMMARY OF THE INVENTION

The objective of the present invention is to provide a process for the production of white oil.

To achieve the objective, the present invention comprises injecting a supercritical fluid into the reactor with the base oil and hydrogen. Injecting the supercritical fluid will result in homogeneous of reaction phase and reduction of the mass transfer resistance between the reactant and the catalyst, the film resistance of the catalyst surface and the diffusion resistance of catalyst holes. The supercritical fluid can also reduce the coke formation, which allows the catalyst to run longer. If the reaction productivity keeps the same as the conventional method, addition of the supercritical fluid will reduce the pressure or the temperature of the reaction.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
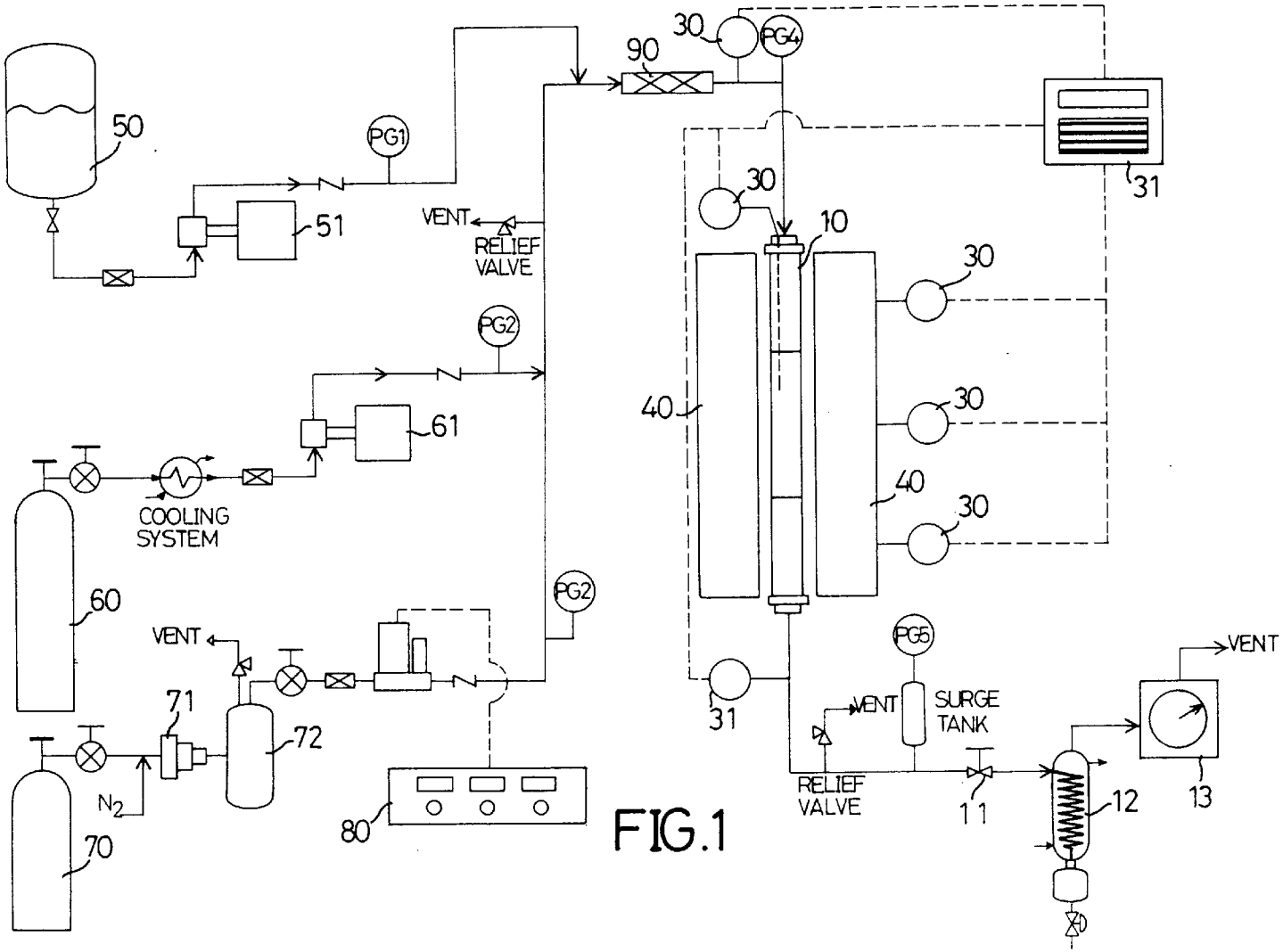
FIG. 1 is a schematic diagram of a white oil production facility in accordance with the present invention.

With reference to FIG. 1, the reactor (10) in accordance with the present invention has an inside diameter of 13 mm, wall thickness of 3 mm and a length of 500 mm. During the process, the temperature of the reactor (10) is maintained within the range 200~400° C. and the pressure of the reactor (10) is maintained within the range 1000~3000 psi. The temperature of the pipes and the reactor (10) are sensed by thermocouples (30). A three-step heater (40) is mounted around the reactor (10).

A base oil tank (50) and a supercritical fluid tank (60) use high-pressure injector pumps (51,61) to feed the system. Hydrogen is fed into the system by using a high-pressure compressor (71) to pump hydrogen from a hydrogen tank (70) to a high-pressure hydrogen storage tank (72). A mass flow controller (80) maintains a steady flow of hydrogen into the system.

To thoroughly mix the reactant (base oil, supercritical fluid and hydrogen), a 12 piece static mixer (90) is mounted inline to the inlet of the reactor (10).

To effectively control the temperature of hydrogenation reaction, several thermocouples (30) are connected to the reactor (10) and inlet and outlet of the reactor (10). The thermocouples (30) can transfer the sensed data to a six point thermograph (31). The pressure of the reactor (10) is controlled by a back pressure regulator (11) mounted downstream from the outlet of the reactor (10).

After the hydrogenation reaction is completed, the pressure of the fluid at the outlet of the back pressure regulator (11) is reduced. A vapor-liquid separator (12) is used to separate vapor and liquid. A gas meter (13) records the total vapor flow.

The viscosity of the base oil is 5~120cSt (40° C.), and the supercritical fluid can be propane, butane or carbon dioxide.

Figure 2:
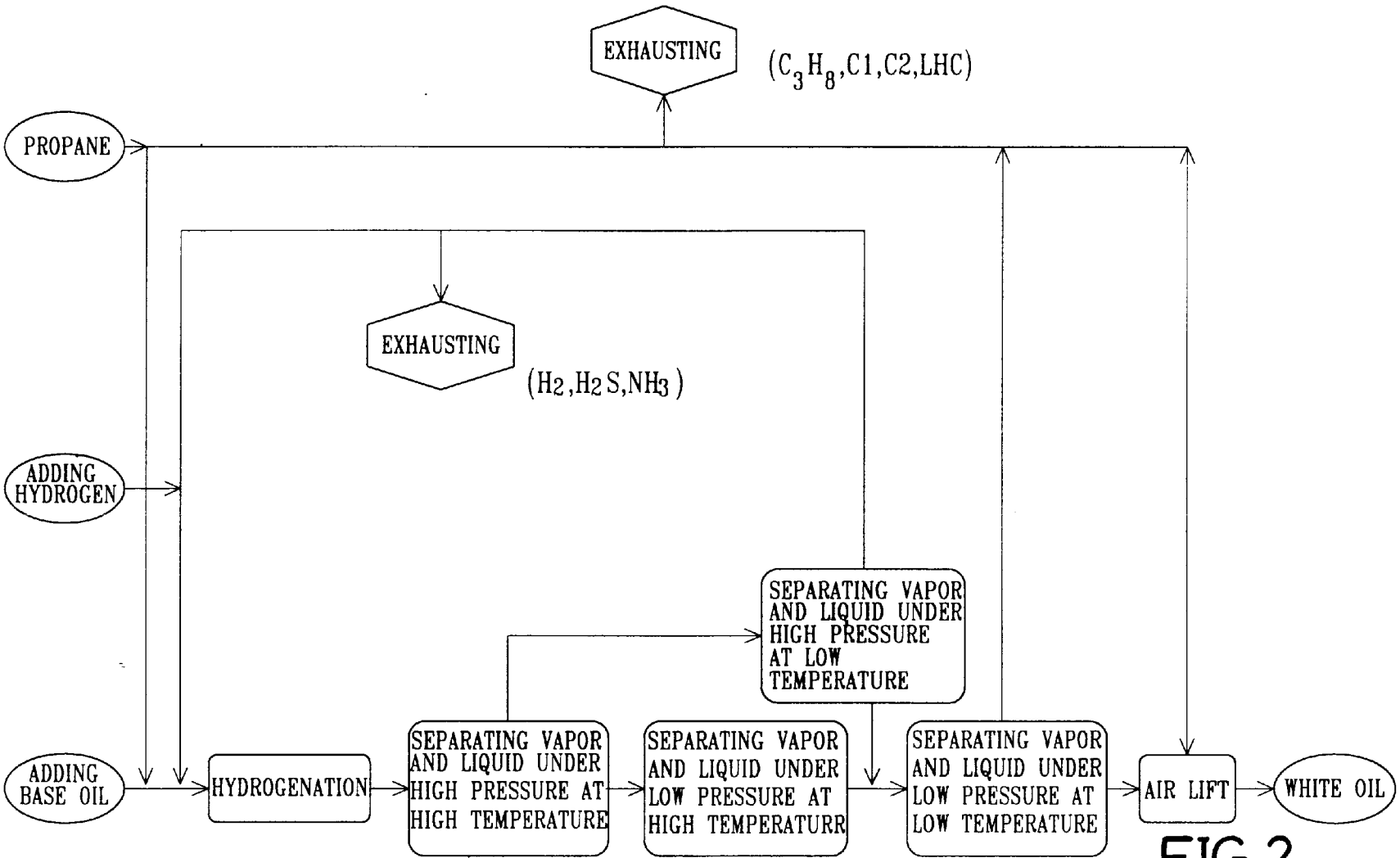
FIG. 2 is a functional block diagram of the white oil production process in accordance with the present invention.

With reference to FIG. 1, the reactant is propane for supercritical fluid and 150N of base oil, and then put them into the reactor (catalyst: Ni—Mo catalyst 10 ml, base oil 10 ml/min and hydrogen 150 scc/min, at a temperature of 350° C. and pressure 2500 psi). The propane is four times the weight of the base oil. With reference to FIG. 2, the base oil reacts with hydrogen in propane, after hydrogenation, then separating vapor and liquid. Besides white oil and propane, much $H_2S$, $NH_3$ and LHC will be formed in the reaction, then separating white oil form other compounds by airlift.

After the reaction, the average reaction rate of unsaturated compound is increased from 1.69%/min to 17.6%/min compare with the conventional method that without adding propane, it means that adding supercritical fluid in the reactor will cause the rate of the reaction to be about 10 times faster.

The composition of the Ni—Mo catalyst is 3 wt % nickel and 13 wt % molybdenum on a catalyst carrier. The catalyst carrier is $Al_2O_3$, and the average size of the catalyst carrier is 1.3 mm (~1/20 in).

During the reaction, the nitrogen and sulfur compound in the base oil will reacted with the hydrogen to form ammonia and hydrogen sulfide, the unsaturated compound will reacted with hydrogen to form a saturated compound.

Although the present invention has been explained in relation to its preferred embodiment, it is to be understood that many other possible modifications and variations can be made without departing from the spirit and scope of the invention as hereinafter claimed.

What is claimed is:

1. A process for the production of white oil comprising the steps of:

a base oil feeding step that uses a high-pressure injector pump to feed a base oil from a storage tank to a mixer mounted inline upstream from an inlet of a reactor;

a hydrogen feeding step that uses a high-pressure compressor to compress hydrogen from a hydrogen storage tank to a compression tank, and then uses a mass flow controller to steadily feed the hydrogen to said mixer;

a supercritical fluid feeding step that uses a high-pressure injector pump to feed supercritical fluid from a storage tank to said mixer;

a mixing step that uses said mixer to thoroughly mix the base oil, hydrogen and supercritical fluid;

a step of adding said base oil, hydrogen and supercritical fluid mixture to said reactor so as to complete a hydrogenation process, wherein the temperature of pipes and said reactor are monitored by thermocouples, and a three-step heater mounted around said reactor controls the reactor temperature;

a temperature controlling step that uses several thermocouples mounted around said reactor, and on the inlet and an outlet of said reactor to sense the temperature of the reactor, wherein the data sensed by the thermocouples are transferred to a six-point thermograph;

a pressure controlling step that uses a back pressure regulator mounted inline downstream from the outlet of said reactor to control the pressure in the reactor; and a separation step that after the completion of the hydrogenation reaction, fluid and vapor is generated as the product of the hydrogenation and a back pressure regulator is used to reduce the pressure of the fluid and vapor in an outlet of said reactor and a vapor-liquid separator is used to separate the vapor and liquid, wherein the base oil has a viscosity between 5~120 cSt (40° C.), and the supercritical fluid is selected from a group consisting of propane dioxide and butane.

2. The process for the production of white oil as claimed in claim 1, wherein the temperature of said reactor is maintained within the range of 200~400° C.

3. The process for the production of white oil as claimed in claim 1, wherein the pressure of said reactor is maintained within the range of 1000~3000 psi.

4. The process for the production of white oil as claimed in claim 1, wherein the mixer of the mixing step is a 12 piece static mixer.

5. The process for the production of white oil as claimed in claim 1, wherein the vapor total flow through the vapor-liquid separator is recorded by a gas meter.

* * * * *